US009103011B2

(12) United States Patent
Sheehan et al.

(10) Patent No.: US 9,103,011 B2
(45) Date of Patent: Aug. 11, 2015

(54) SOLUTION HEAT TREATMENT AND OVERAGE HEAT TREATMENT FOR TITANIUM COMPONENTS

(75) Inventors: Kevin C. Sheehan, Orlando, FL (US); Kenneth Kirch Starr, Orlando, FL (US); Brij B. Seth, Maitland, FL (US)

(73) Assignee: Siemens Energy, Inc., Orlando, FL (US)

( * ) Notice: Subject to any disclaimer, the term of this patent is extended or adjusted under 35 U.S.C. 154(b) by 1481 days.

(21) Appl. No.: 12/212,865

(22) Filed: Sep. 18, 2008

(65) Prior Publication Data

US 2010/0065158 A1 Mar. 18, 2010

(51) Int. Cl.

| | |
|---|---|
| ***C22F 1/16*** | (2006.01) |
| ***C22F 1/18*** | (2006.01) |
| ***C22C 14/00*** | (2006.01) |

(52) U.S. Cl.

CPC . *C22F 1/18* (2013.01); *C22C 14/00* (2013.01); *C22F 1/183* (2013.01)

(58) Field of Classification Search

USPC ..... 148/516

See application file for complete search history.

(56) References Cited

U.S. PATENT DOCUMENTS

| | | | |
|---|---|---|---|
| 4,134,758 | A | 1/1979 | Nagai et al. |
| 4,898,624 | A | 2/1990 | Chakrabarti et al. |
| 5,032,189 | A | 7/1991 | Eylon et al. |
| 5,861,070 | A | 1/1999 | Reichman et al. |
| 6,127,044 | A | 10/2000 | Yamamoto et al. |
| 6,190,473 | B1 | 2/2001 | Martin |

FOREIGN PATENT DOCUMENTS

| | | |
|---|---|---|
| EP | 716155 A1 | 12/1996 |
| GB | 1392382 | 4/1975 |

OTHER PUBLICATIONS

G.W. Kuhlman; A Critical. Appraisal of Thermomechanical Processing of Structural Titanium Alloys; Microstructure/Property Relationships in Titanium Aluminides and Alloys; Oct. 7-11, 1990; pp. 465-491; The Minerals, Metals & Materials Society; Warrendale, PA; USA.

*Primary Examiner* — Rebecca Lee

(57) ABSTRACT

A method of fabricating a Ti-6Al-4V titanium alloy component including solution heat treating a forged Ti-6Al-4V titanium alloy component at a temperature within the alpha+beta two-phase field for the material of the component for a predetermined period of time, and subsequently cooling the component. The component is then age heat treated using an overaging process at a predetermined overaging temperature for a predetermined time, and the component is cooled to room temperature. The overaging temperature is selected to be a higher temperature than an aging heat treatment temperature for effecting a maximum yield strength in the component.

15 Claims, 3 Drawing Sheets

SOLUTION HEAT TREATMENT AND OVERAGE HEAT TREATMENT FOR TITANIUM COMPONENTS

FIELD OF THE INVENTION

The present invention relates to titanium alloys and, more particularly, to processing of forged titanium components to improve the mechanical properties of the components.

BACKGROUND OF THE INVENTION

Titanium alloys are widely used in the production of rotating blades for steam turbines. In particular, the rotating blades within low pressure steam turbines are exposed to high-speed collision of wet steam, causing erosion and abrasion due to the wet droplets in the steam. Titanium alloys exhibit a desirable level of resistance to the steam environment found within such turbines, where various treatments of the titanium alloy have been required to improve the service life of the rotating blades. For example, a Ti-6Al-4V titanium alloy, is an alpha-beta titanium alloy comprising a high strength material commonly used for turbine engine components consisting principally of about 6 percent aluminum, 4 percent vanadium, and the balance titanium and other constituents.

Typically, titanium alloy components for turbine engine applications are produced through a forging process, followed by a heat treatment process designed to assure adequate strength and ductility. Various processes have been proposed to produce improved characteristics of the material forming the final component. For example U.S. Pat. No. 5,032,189 describes a process of fabricating forged near alpha and alpha+beta titanium alloy components including forging an alloy billet at or above the beta-transus temperature, heating the forged component at a temperature approximately equal to the beta-transus temperature, cooling the component and annealing the component at a temperature approximately 10-20% below the beta-transus temperature for about 4 to 36 hours.

Another approach to improving the mechanical properties of titanium alloys is described in U.S. Pat. No. 4,898,624. A titanium alloy is described having the following composition: 5.5 to 6.75% Aluminum, 3.5 to 4.5% Vanadium, 0.15 to 0.2% Oxygen, 0.025 to 0.05% Nitrogen, ≤0.3% Iron, 0 to ≤0.08% Carbon, 0 to ≤0.0125% Hydrogen, 0 to ≤0.005% Yttrium, residual elements each 0 to ≤0.1% total 0 to ≤4%, and the remainder Ti. The alloy is prepared with heat treatment processes to produce a microstructure having nearly equiaxed primary alpha particles with platelets of secondary alpha in an aged beta matrix, where the fracture toughness ($K_{IC}$) is about 45 ksi-in$^{1/2}$.

Changes to the microstructure of the titanium alloy to improve the fracture toughness generally require a compromise in other material properties. Such a compromise typically includes a reduction in the yield strength and/or a reduction in the ductility of the material. Accordingly, it is desirable to provide an improved process for increasing the fracture toughness of a titanium alloy while maintaining or limiting the reduction of other properties such as yield strength.

SUMMARY OF THE INVENTION

In accordance with one aspect of the invention, a method of fabricating a Ti-6Al-4V titanium alloy component is provided. The method comprises the steps of: providing a forged Ti-6Al-4V titanium alloy component; solution heat treating the component at a solution temperature relatively high within the alpha+beta two-phase field for the material of the component and at least 54° F. below the beta transus temperature, and for a predetermined period of time; cooling the component to a temperature below the temperature of the alpha+beta two-phase field; overage heat treating the component comprising an overaging process at a predetermined overaging temperature for a predetermined time; cooling the component to room temperature; and wherein the overaging temperature comprises a temperature lower than the solution temperature but higher than an aging heat treatment temperature for effecting a maximum yield strength in the component.

In accordance with another aspect of the invention, a method of fabricating a component formed Of Ti-6Al-4V titanium alloy is provided. The method comprising the steps of: providing a forged Ti-6Al-4V titanium alloy component comprising at least 50% primary alpha; solution heat treating the component at a solution temperature within the alpha+beta two-phase field for the material of the component for approximately one hour; quench cooling the component to a temperature below the temperature of the alpha+beta two-phase field; overage heat treating the component comprising an overaging process at a predetermined temperature for approximately one hour; air cooling the component to room temperature; and wherein the overaging temperature comprises a temperature lower than the solution temperature but higher than an aging heat treatment temperature for effecting a maximum yield strength in the component.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
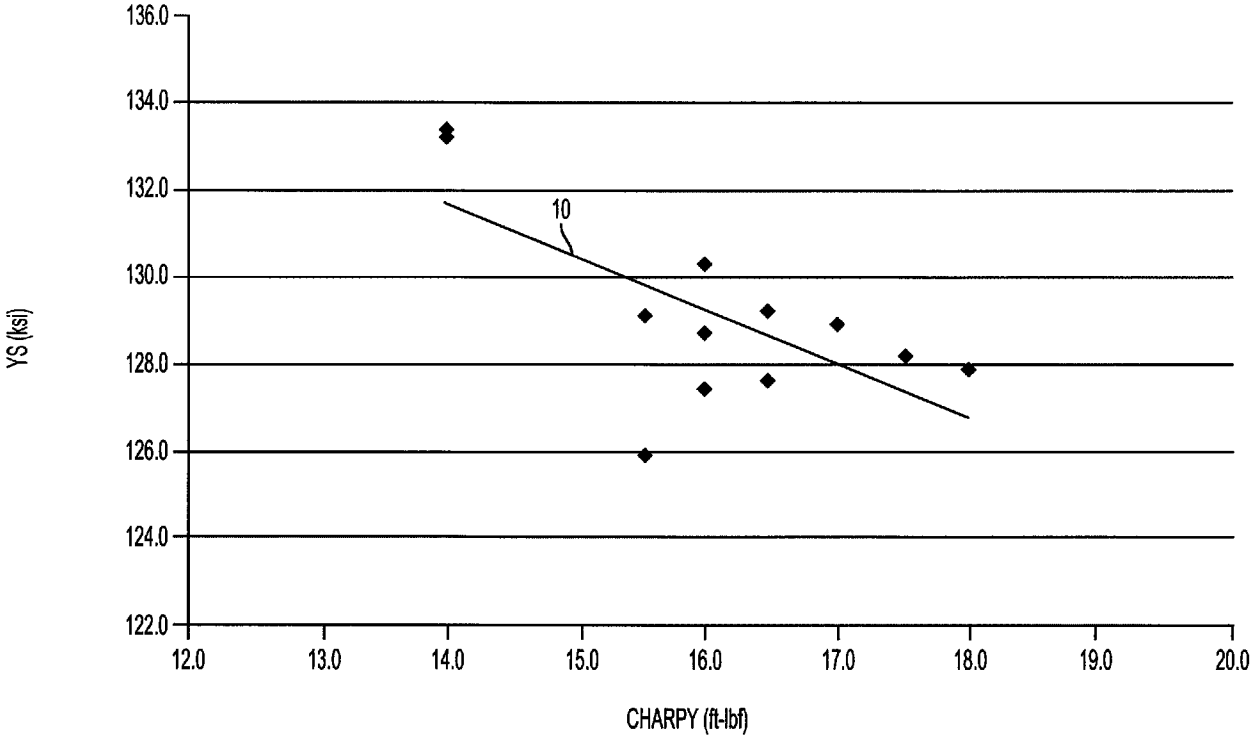
FIG. 1 PRIOR ART
FIG. 1 is a plot illustrating the relationship between yield strength of a material and material toughness, as measured by Charpy V-notch testing, for samples treated according to conventional heat treatment conditions.

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

The present invention is directed to a process for providing improved properties in a forged component formed from an alpha+beta titanium alloy, and particularly formed from a Ti-6Al-4V titanium alloy. The Ti-6Al-4V alloys that may be used to obtain the improved properties have the general composition as specified per AMS 4928Q, and listed in Table 1 as follows:

TABLE 1

| Element | Composition, wt % |
|---|---|
| Aluminum | 5.50-6.75 |
| Vanadium | 3.50-4.50 |
| Iron, max | 0.30 |
| Oxygen, max | 0.20 |
| Carbon, max | 0.08 |
| Nitrogen, max | 0.05 |
| Hydrogen, max | 0.0125 |
| Yttrium, max | 0.0050 |
| Other elements, Each | 0.10 |
| Other elements, Total | 0.40 |
| Titanium | Remainder |

The material is typically provided as bars for use in forming a forged component, where the microstructure of the bars comprises uniform, essentially equiaxed, primary alpha phase in a transformed beta matrix, as determined from a transverse and/or longitudinal micrograph. The structure contains at least 50% primary alpha, and the alpha grain size averages ASTM 8 or finer, as determined from transverse and longitudinal micrographs.

A component is formed from the above-described material through a forging process. Any type of component may be formed in accordance with the present invention. However, for the purposes of the present description, a forged rotating turbine blade configured for use in a steam turbine is referenced as an illustrative example.

To create a desirable microstructure in the forged component, the component is subjected to a two-step heat treatment process comprising:

1) a solution heat treatment below the beta-transus temperature for the material; and 2) an overaging heat treatment within the alpha+beta two-phase field, but below the solution heat treatment temperature for the material.

In particular, a first, higher temperature solution heat treatment, sometimes referred to as a solution anneal, was initially performed at a temperature relatively high within the alpha+beta two-phase field for the material, but at least 54° F. (30° C.) below the beta transus temperature. Subsequently, a second, lower temperature overaging heat treatment, sometimes referred to as an anneal, was performed. As described below, particular temperatures or temperature ranges are identified for the two steps of the heat treatment process to provide the particular material properties for a forged component described herein. Specifically, temperatures are described for the heat treatment process to provide an increase in material toughness, where a selected temperature for the second step of the heat treatment process comprises a higher temperature than an aging heat treatment temperature that may be expected to effect a maximum yield strength in the material.

The first, solution heat treatment may occur within a predetermined temperature range from approximately 1675° F. (913° C.) to approximately 1775° F. (968° C.), locating the temperature between the upper and lower limits of the alpha+beta two-phase field, and preferably within the upper portion of the alpha+beta two-phase field. For purposes of ensuring that the selected solution heat treatment temperature is well within the limits of the alpha+beta two-phase field, the temperature range preferably may be set within a range from approximately 1725° F. (940° C.) to approximately 1775° F. (968° C.). The particular temperature for the solution heat treatment may be set with reference to the beta-transus temperature for the material being treated, where the specified range is considered to cover the range of possible beta-transus temperatures for the material provided herein. The solution heat treatment is conducted for a predetermined time period, which is preferably 1 hour −10 minutes/+20 minutes. In the preferred embodiment, the solution heat treated component may be either air cooled or water cooled to a predetermined temperature, such as a temperature that is lower than the temperature of the aging heat treatment.

The second, overaging heat treatment may occur within a temperature range of approximately 1300° F. (704° C.) to approximately 1500° F. (815° C.). The overaging heat treatment preferably occurs at a temperature of at least approximately 1382° F.±25° F. (750° C.±14° C.), and most preferably at a temperature of 1450° F.±25° F. (788° C.±14° C.). The overaging heat treatment is conducted for a predetermined time period, which is preferably 1 hour −10 minutes/+20 minutes. Because the overaging heat treatment utilizes higher aging temperatures relative to typical aging temperatures, e.g., approximately 900° F. (482° C.) to 1100° F. (593° C.), this is referred to as overaging heat treatment. The combined process of solution heat treatment and overaging heat treatment may be referred to as solution treated and overaged (STOA).

The Charpy V-notch impact energy of a heat treated specimen is generally inversely proportional to the yield strength for the specimen. This is illustrated in FIG. 1 which plots the yield strength versus the Charpy V-notch impact energy for a variety of bar samples, performed at room temperature. The plot of FIG. 1 includes data from samples treated according to conventional solution treated and overaged (STOA) heat treatment conditions, where the conditions are varied to produce different material characteristics, i.e., different yield strength and toughness. The line 10 in FIG. 1 depicts a relationship of yield strength to Charpy value for a water quench (WQ) from the solution heat treatment temperature, where the Charpy value decreases with increasing yield strength.

The Charpy V-notch value is a measure of the toughness of a material. It is typically considered desirable to increase the toughness of a material, in that small flaws in a component are generally less likely to propagate to a critical size in a material as the toughness is increased. On the other hand, yield strength is a description of a material's ability to elastically deform. Hence, as the characteristics of a material are changed to increase the toughness, and thus increase its tolerance to flaws, there is a corresponding decrease in the material's strength, and thus a decrease in its ability to elastically deform.

For the purposes of comparing specimens subjected to different heat treatment processes, the toughness of the specimens is described in terms of a fracture toughness $K_{IC}$, which is an empirically derived relationship between yield strength and Charpy V-notch values, and is defined as:

$$K_{IC}=[5\sigma_Y(\mathrm{CVN}-\sigma_Y/20)]^{0.5} \quad (1)$$

where:

$K_{IC}$=fracture toughness in ksi-in$^{1/2}$;

$\rho_Y$=yield strength in ksi; and

CVN=Charpy V-notch impact energy in ft-lbf.

It should be noted that the calculated fracture toughness, $K_{IC}$, is substantially similar to measured values of fracture toughness, $K_{IC}$. Hence, for the purposes of the present description, the calculated fracture toughness, $K_{IC}$, will be referenced in describing the effects of the heat treatment processes herein.

A heat treatment process in accordance with the present invention is intended to increase the fracture toughness of the titanium alloy forged component while minimizing any decrease in other mechanical properties. In particular, any increase in fracture toughness should be provided within the constraints of the mechanical properties set forth in Table 2 as follows:

TABLE 2

| | |
|---|---|
| Tensile Strength, Psi (MPa), Min. | 130,000 (896) |
| Yield Strength @ 2% offset, Psi (MPa), Min. | 125,000 (862) |
| Elongation in 2 in. (50 mm) or 4D, %, Min. Longitudinal (Tensile Ductility) | 10 |
| Reduction of Area, % Min. Longitudinal | 25 |
| Dynamic Modulus, Psi | $17.3 \times 10^6 \pm 5\%$ |

In addition to the above mechanical properties, the microstructure of a titanium alloy forged component heat treated in accordance with the present invention comprises approximately 30%-50% primary alpha in a lamellar alpha+beta matrix.

EXAMPLE 1

Three Ti-6Al-4V titanium alloy blade forgings having the composition described in Table 1 were formed comprising at least 50% primary alpha. The blade forgings were solution heat treated at a temperature of 1740° F. (949° C.) for 1 hour, followed by water quench cooling. The blade forgings were then overage heat treated at a temperature of 1382° F. (750° C.) for 1 hour, followed by air cooling. The three blade forgings had an average yield strength of 150.8 ksi and an average calculated fracture toughness, $K_{IC}$, of 53.2 ksi-in$^{1/2}$. In addition, the heat treated blade forgings had a tensile ductility greater than 10%.

EXAMPLE 2

Figure 3A:
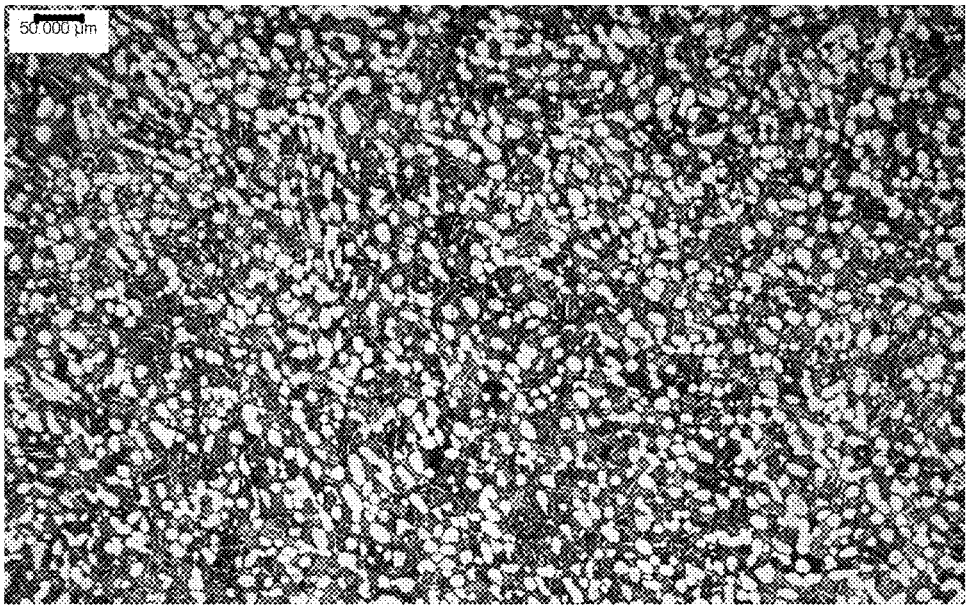
FIGS. 3A and 3B are photomicrographs of a blade forging prepared in accordance with a second example of the invention and showing the material of the blade forging at magnifications of 100× and 500×, respectively.
Figure 3B:
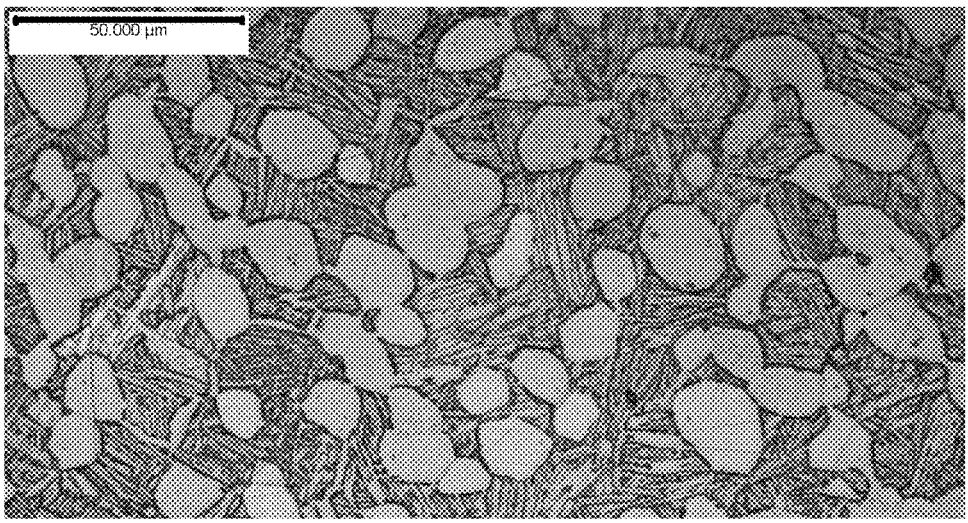

Five Ti-6Al-4V titanium alloy blade forgings having the composition described in Table 1 were formed comprising at least 50% primary alpha. The blade forgings were solution heat treated at a temperature of 1740° F. (949° C.) for 1 hour, followed by water quench cooling. The blade forgings were then age heat treated at a temperature of 1450° F. (788° C.) for 1 hour, followed by air cooling. The five blade forgings had an average yield strength of 134.4 ksi and an average calculated fracture toughness, $K_{IC}$, of 75.5 ksi-in$^{1/2}$. In addition, the heat treated blade forgings had an average tensile ductility of about 13.8%. Photomicrographs of a blade forging prepared in accordance with this example are shown in FIGS. 3A and 3B, illustrating magnifications of the blade forging of 100× and 500×, respectively. The grain size shown in FIGS. 3A-B is about ASTM 9-11, and the primary alpha content in the lamellar alpha+beta matrix is about 40-45%.

Figure 2:
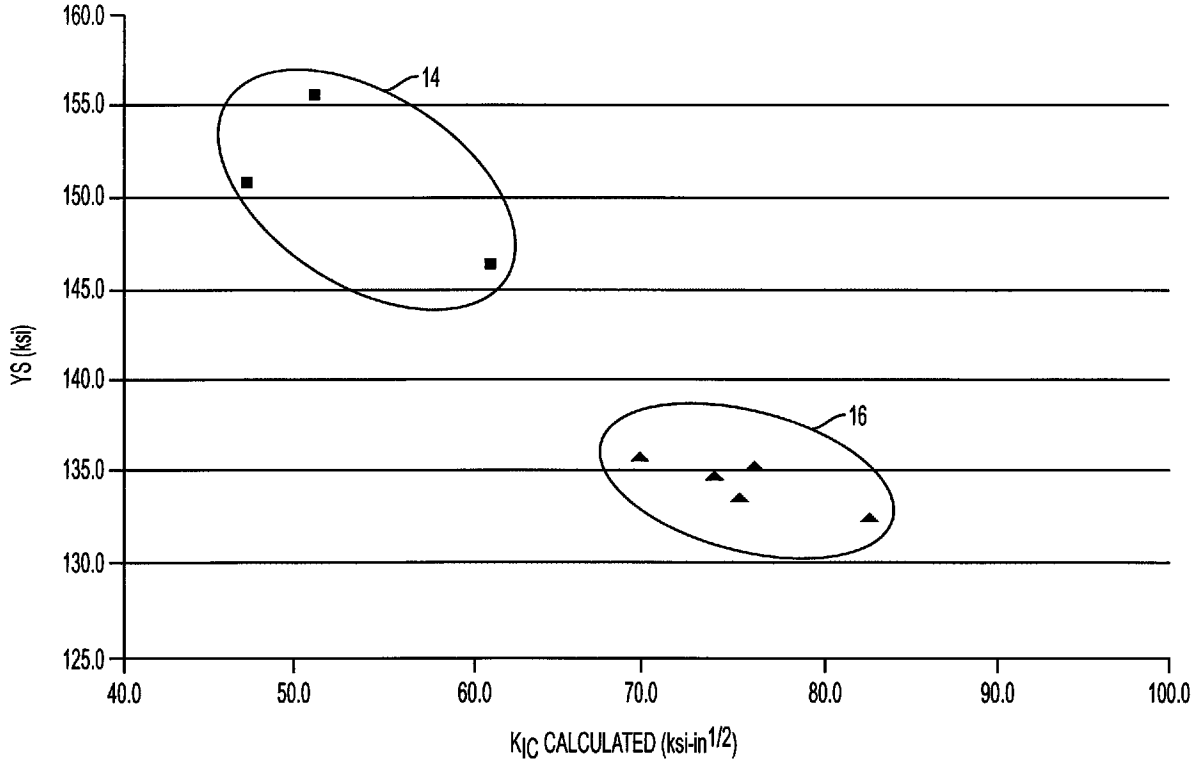
FIG. 2 is a plot showing the results of two heat treatment processes performed in accordance with the present invention.

The results of the heat treatments described in Example 1 and Example 2 are illustrated in the plot of FIG. 2. The plot illustrates that the blade forgings heat treated according to Example 1, generally identified at 14 in FIG. 2, have a fracture toughness, $K_{IC}$, above approximately 50 ksi-in$^{1/2}$ and a yield strength greater than approximately 145 ksi, substantially exceeding the minimum yield strength requirement of 125 ksi.

The blade forgings heat treated according to Example 2, generally identified at 16 in FIG. 2, have a fracture toughness, $K_{IC}$, of at least approximately 70 ksi-in$^{1/2}$ and a yield strength of at least approximately 130 ksi. Hence, it can be seen that the overaging temperature of the second heat treatment step in Example 2 results in a substantial increase in the fracture toughness, $K_{IC}$, of the blade forgings with an accompanying decrease in yield strength below a value that may be considered a maximum or optimum yield strength value, but still well above the minimum required yield strength. Specifically, in comparing the relative change in fracture toughness and yield strength from the heat treatment process of Example 1 to that of Example 2, there is a 41.9% average increase in the fracture toughness of the blade forgings of Example 2, along with a 10.9% average decrease in the yield strength.

Thus, while the greater fracture toughness, $K_{IC}$, provided to the blade forgings heat treated according to Example 2 is obtained at the expense of some yield strength, the percentage increase in the fracture toughness is substantially greater than the percentage decrease in yield strength. Further, since the gain in fracture toughness provided by the process of Example 2 is obtained in combination with maintaining the yield strength at a value substantially higher than the minimum required yield strength of 125 ksi, the heat treatment process of Example 2, and the resulting heat treated blade forging, is considered a preferred embodiment of the invention described herein.

The forged component may be subjected to subsequent finishing operations, such as machining of the component and a stress relief process. For example, following a machining operation, a stress relief process may be applied comprising heating the component to approximately 1100° F. (593° C.) for 2 hours. Such a finishing operation will not affect the microstructure of the final forged component, as provided by the heat treating processes described herein.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of fabricating a Ti-6AI-4V titanium alloy component comprising sequential steps of:

a) providing a forged Ti-6AI-4V titanium alloy component;

b) solution heat treating the component at a solution temperature relatively high within an alpha +beta two-phase field for the material of the component and at least 54° F. below the beta transus temperature comprising a temperature within a range of about 1675° F. to about 1775° F., and for a predetermined period of time;

c) cooling the component to a temperature below the temperature of the alpha +beta two-phase field;

d) overage heat treating the component comprising an overaging process at a predetermined overaging temperature comprising a temperature greater than 1357° F. and less than 1500° F. for a predetermined time;

e) cooling the component from the predetermined temperature of step d) to room temperature; and wherein the overaging temperature comprises a temperature lower than the solution temperature but higher than an aging heat treatment temperature for effecting a maximum yield strength in the component, and wherein the resulting structure of the component has a fracture toughness, $K_{IC}$, greater than 50 ksi-in$^{1/2}$and a yield strength greater than about 125 ksi.

2. The method of claim 1, wherein step a) comprises providing a forged titanium component comprising at least 50% primary alpha.

3. The method of claim 1, wherein the resulting structure of the component comprises approximately 30%-50% primary alpha in a lamellar alpha+beta matrix.

4. The method of claim 1, wherein step b) comprises solution heat treating the component at a temperature of approximately 1740° F.

5. The method of claim 1, wherein the overaging temperature is approximately 1450° F.±25° F.

6. The method of claim 1, wherein the predetermined period of time for solution heat treating the component in step b) and the predetermined time for age heat treating the component in step d) each comprise approximately one hour.

7. The method of claim 1, wherein step c) comprises cooling the component at a cooling rate in excess of an air cooling rate.

8. The method of claim 1, wherein the resulting structure of the component has a fracture toughness, $K_{IC}$, of at least approximately 70 ksi-in$^{1/2}$ and a yield strength of at least approximately 130 ksi.

9. The method of claim 1, wherein the resulting structure of the component has a minimum ductility of approximately 10%.

10. A method of fabricating a component formed of Ti-6Al-4V titanium alloy, the method comprising sequential steps of:

a) providing a forged Ti-6AI-4V titanium alloy component comprising at least 50% primary alpha;

b) solution heat treating the component at a solution temperature relatively high within an alpha+beta two-phase field for the material of the component for approximately one hour;

c) quench cooling the component to a temperature below the temperature of the alpha+beta two-phase field;

d) overage heat treating the component comprising an overaging process at a predetermined temperature for approximately one hour;

e) air cooling the component from the predetermined temperature of step d) to room temperature; and wherein the overaging temperature comprises a temperature lower than the solution temperature but higher than an aging heat treatment temperature for effecting a maximum yield strength in the component, and wherein the resulting structure of the component has a fracture toughness, $K_{IC}$, of at least about 70 ksi-in$^{1/2}$ and a yield strength of at least about 130 ksi.

11. The method of claim 10, wherein the resulting structure of the component comprises approximately 30%-50% primary alpha in a lamellar alpha+beta matrix.

12. The method of claim 10, wherein step b) comprises solution heat treating the component at a temperature within a range of approximately 1675° F. to approximately 1775° F.

13. The method of claim 12, wherein step d) comprises overage heat treating the component at an overaging temperature within a range of approximately 1300° F. to approximately 1500° F.

14. The method of claim 13, wherein the overaging temperature is at least approximately 1382° F.±25° F.

15. The method of claim 14, wherein the overaging temperature is approximately 1450° F.±25° F.

* * * * *